US011846186B2

(12) United States Patent
Stokes

(10) Patent No.: US 11,846,186 B2
(45) Date of Patent: Dec. 19, 2023

(54) WHIPSTOCK WITH HINGED TAPERFACE

(71) Applicant: Halliburton Energy Services, Inc., Houston, TX (US)

(72) Inventor: Matthew Bradley Stokes, Keller, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/124,213

(22) Filed: Dec. 16, 2020

(65) Prior Publication Data

US 2022/0186562 A1 Jun. 16, 2022

(51) Int. Cl.

| | |
|---|---|
| ***E21B 7/06*** | (2006.01) |
| ***E21B 23/12*** | (2006.01) |
| *E21B 23/00* | (2006.01) |
| *E21B 23/03* | (2006.01) |
| *E21B 41/00* | (2006.01) |

(52) U.S. Cl.
CPC ..... *E21B 7/061* (2013.01); *E21B 23/00* (2013.01); *E21B 23/03* (2013.01); *E21B 23/12* (2020.05); *E21B 41/0035* (2013.01)

(58) Field of Classification Search
CPC ..... E21B 7/061; E21B 23/03; E21B 23/12; E21B 41/0035
See application file for complete search history.

(56) References Cited

U.S. PATENT DOCUMENTS

| | | | | |
|---|---|---|---|---|
| 5,398,754 | A * | 3/1995 | Dinhoble | E21B 31/16 175/81 |
| 5,409,060 | A | 4/1995 | Carter | |
| 5,787,978 | A | 8/1998 | Carter et al. | |
| 6,019,173 | A | 2/2000 | Saurer et al. | |
| 6,035,939 | A | 3/2000 | Carter | |
| 6,843,314 | B2 | 1/2005 | Toulouse et al. | |
| 7,448,446 | B2 | 11/2008 | Campbell et al. | |
| 7,487,846 | B2 | 2/2009 | Head et al. | |
| 8,459,345 | B2 | 6/2013 | Bell | |
| 2004/0108739 | A1 | 6/2004 | Beeman et al. | |
| 2005/0230151 | A1 | 10/2005 | McGarian et al. | |
| 2010/0012322 | A1 | 1/2010 | McGarian | |
| 2012/0241144 | A1* | 9/2012 | Bell | E21B 7/061 166/117.5 |
| 2016/0145956 | A1* | 5/2016 | Dahl | E21B 29/06 166/382 |
| 2017/0044866 | A1* | 2/2017 | Bulloch | E21B 29/06 |
| 2019/0120021 | A1* | 4/2019 | Steele | E21B 37/00 |

FOREIGN PATENT DOCUMENTS

WO 03083250 A1 10/2003

* cited by examiner

*Primary Examiner* — Christopher J Sebesta
*Assistant Examiner* — Lamia Quaim
(74) *Attorney, Agent, or Firm* — Scott Richardson; Parker Justiss, P.C.

(57) ABSTRACT

Provided, in one aspect, is a whipstock. The whipstock may include a tubular having a longitudinal passageway extending along a length thereof, the tubular having a tapered face extending along at least a portion of the length; a support structure movably coupled to the tubular and extendable across the tapered face, wherein the support structure is operable to move from a first closed position closing the longitudinal passageway and a second open position exposing the longitudinal passageway; and a locking mechanism in the tubular for releasably holding the support structure in the first position.

12 Claims, 7 Drawing Sheets

WHIPSTOCK WITH HINGED TAPERFACE

BACKGROUND

Multilateral wells include one or more lateral wellbores extending from a main wellbore. A lateral wellbore is a wellbore that is diverted from the main wellbore. A multilateral well may include one or more windows or casing exits to allow corresponding lateral wellbores to be formed. The window or casing exits for multilateral wells are typically formed by positioning one or more whipstock assemblies in a casing string with a running tool at desired locations in the main wellbore. In some embodiments, whipstocks may be used to deflect a window mill relative to the casing string. The deflected window mill penetrates part of the casing joint to form the window or casing exit in the casing string and is then withdrawn from the wellbore. Downhole assemblies can be subsequently inserted through the casing exit in order to cut the lateral wellbore, fracture the lateral wellbore, and/or service the lateral wellbore.

BRIEF DESCRIPTION

Reference is now made to the following descriptions taken in conjunction with the accompanying drawings, in which.

DETAILED DESCRIPTION

A subterranean formation containing oil and/or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased (e.g., open-hole) portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers to a direction that is towards the surface of the well, while the term "downhole" refers to a direction that is away from the surface of the well.

Figure 1:
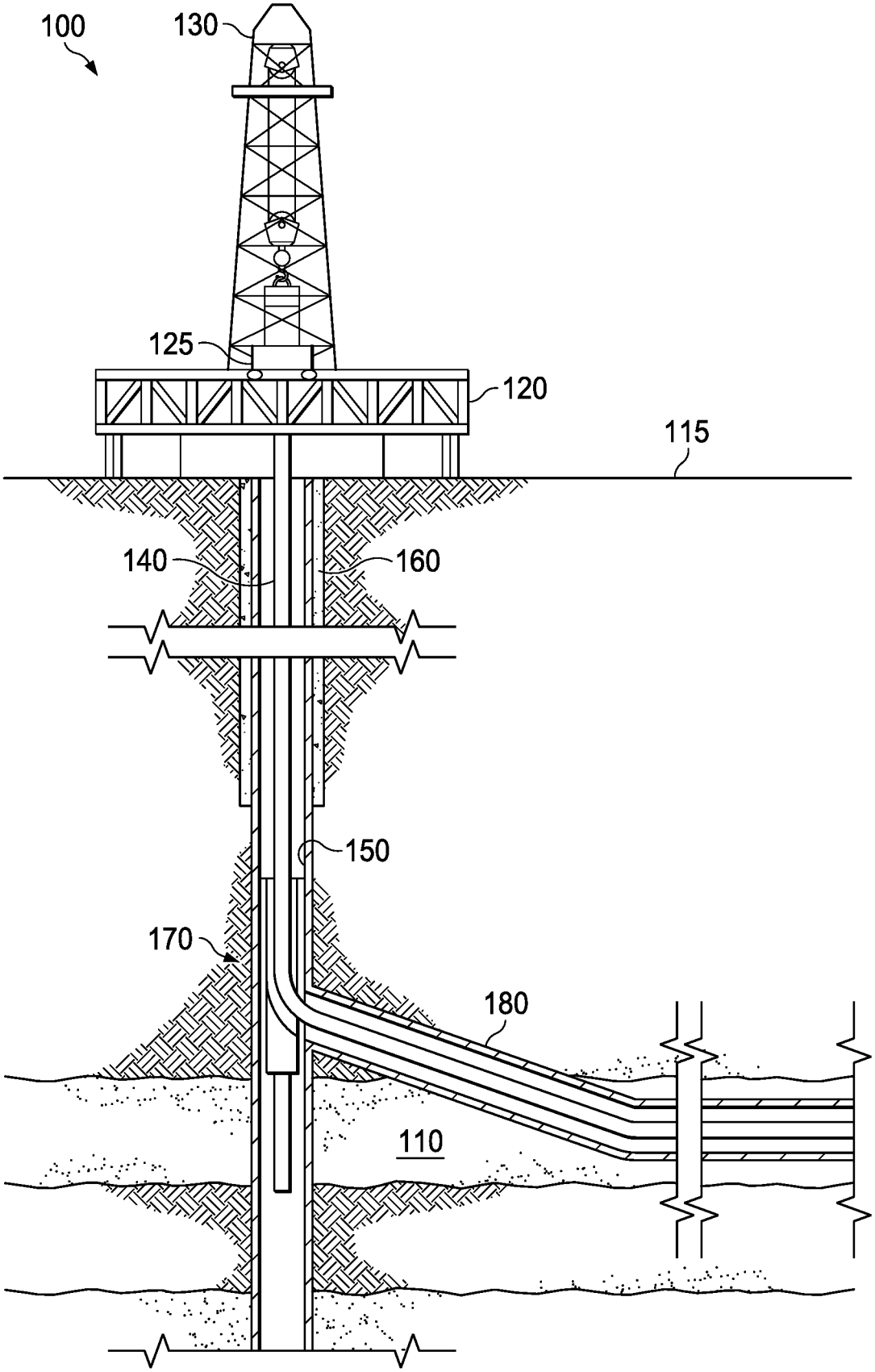
FIG. 1 is a schematic view of a multilateral well according to one or more embodiments disclosed herein.

FIG. 1 is a schematic view of a multilateral well 100 according to one or more embodiments disclosed herein. The multilateral well 100 includes a platform 120 positioned over a subterranean formation 110 located below the earth's surface 115. The platform 120, in at least one embodiment, has a hoisting apparatus 125 and a derrick 130 for raising and lowering pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based multilateral wells different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock 170 according to one or more embodiments of the present disclosure may be positioned at a location in the main wellbore 150. Specifically, the whipstock 170 would be placed at a location in the main wellbore 150 where it is desirable for a lateral wellbore 180 to exit. Accordingly, the whipstock 170 may be used to support a milling tool used to penetrate a window in the main wellbore 150, and once the window has been milled and a lateral wellbore 180 formed, in some embodiments, the whipstock 170 may be retrieved and returned uphole by a retrieval tool, in some embodiments in only a single trip.

The whipstock 170, in one or more embodiments, would include a tubular having a longitudinal passageway extending along a length thereof, the tubular having a tapered face extending along at least a portion of the length. The whipstock 170, in this embodiment, would further include a support structure movably coupled to the tubular and extendable across the tapered face, wherein the support structure is operable to move from a first closed position closing the longitudinal passageway and a second open position exposing the longitudinal passageway, and a locking mechanism in the tubular for releasably holding the support structure in the first position. In accordance with this embodiment, the milling tool would damage the locking mechanism as the window in the casing is being formed, thereby allowing the support structure to move from the first closed position to the second open position. Accordingly, the retrieval tool would have access to the longitudinal passageway for the easy removal of the whipstock 170 after the lateral wellbore has been completed.

Figure 2A:
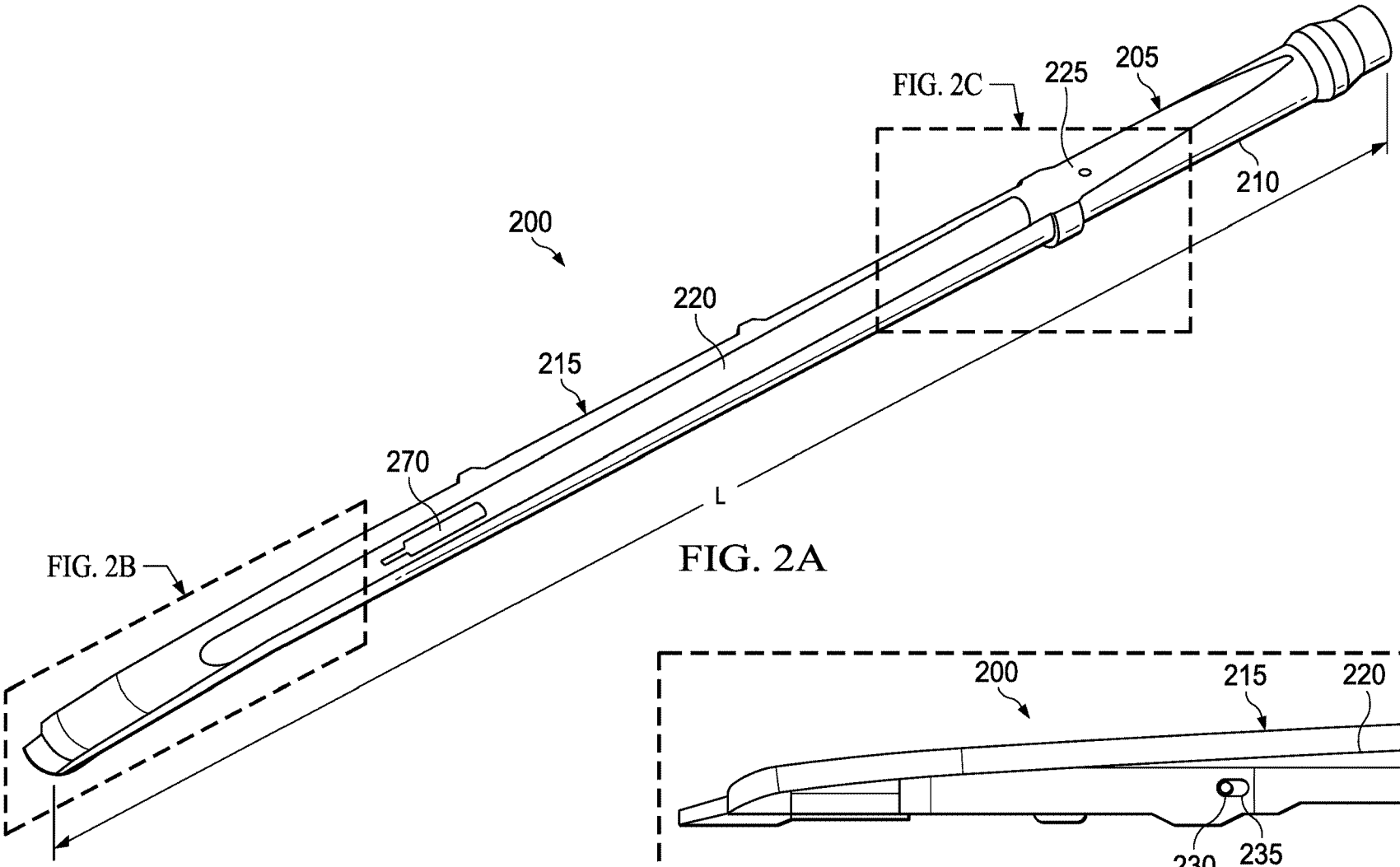
FIG. 2A illustrates a whipstock designed and manufactured according to one or more embodiments of the disclosure.

Turning now to FIG. 2A, illustrated is one embodiment of a whipstock 200 designed and manufactured according to one or more embodiments of the disclosure. The whipstock 200, in one embodiment, may include a tubular 205 having a longitudinal passageway 210 extending along a length (L) thereof. In the illustrated embodiment, the tubular 205 may include a tapered face 215, which may extend along at least a portion of the length (L). A support structure 220 may be movably coupled to the tubular 205 and in some embodiments, may be extendable across the tapered face 215 for supporting a downhole tool (e.g., a milling tool) as it passes over the whipstock 200 when forming a lateral wellbore. The support structure 220 may be operable to move from a first closed position closing the longitudinal passageway 210 (as shown in FIGS. 2A and 2C) and a second open position exposing the longitudinal passageway 210 (as shown in FIG. 2D). The tubular 205 includes a locking mechanism 225, which may be configured for releasably holding the support structure 220 in the first position during insertion into the wellbore and as downhole tools pass there over.

Figure 2B:
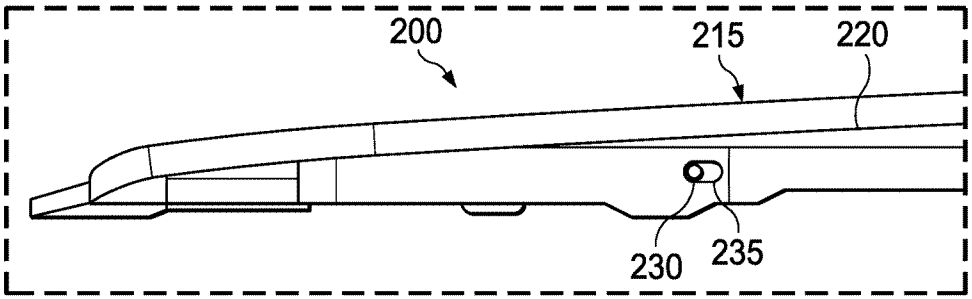
FIG. 2B is an enlarged view of one aspect of the whipstock of FIG. 2A near its uphole end.
Figure 2C:
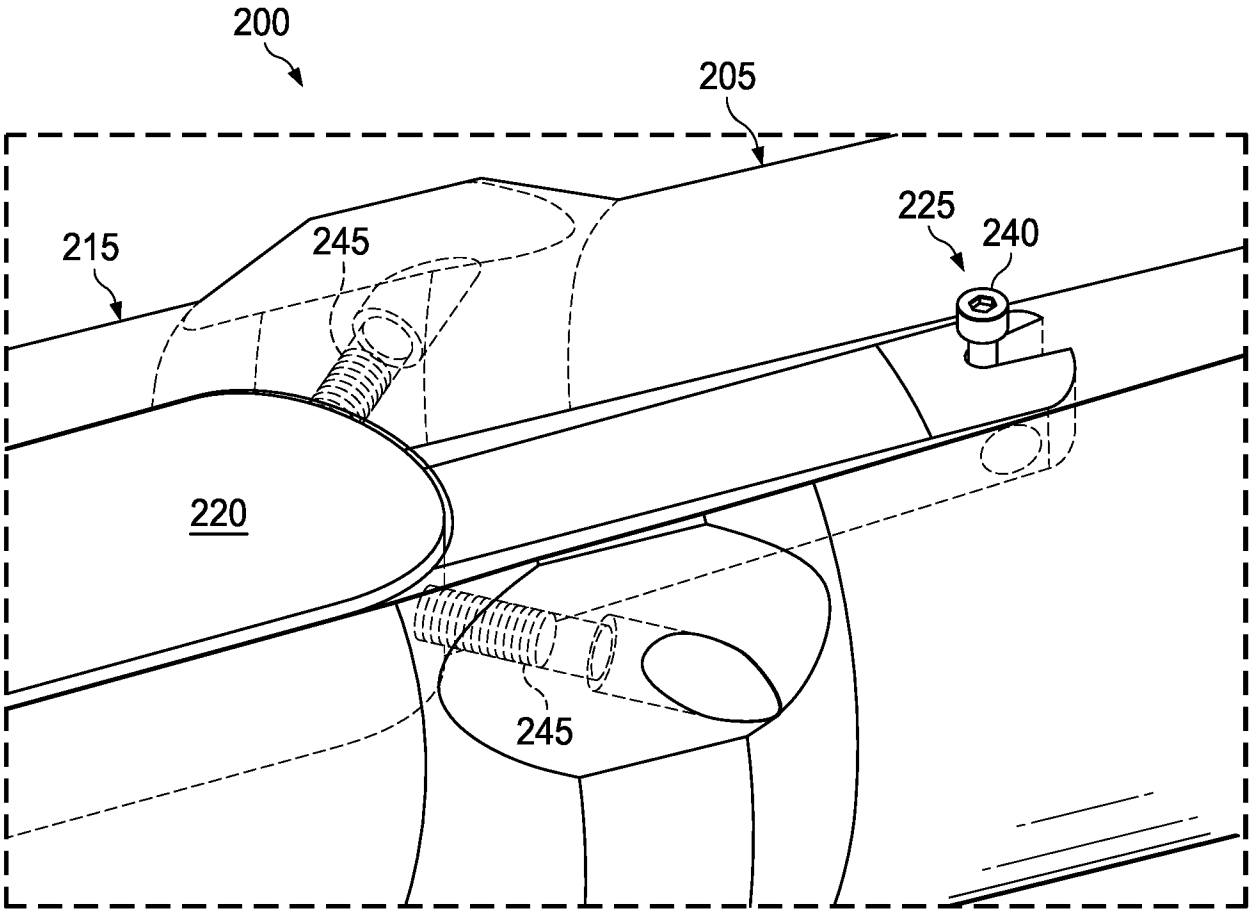
FIG. 2C is an enlarged view of one aspect of the whipstock of FIG. 2A shown in a first position.
Figure 2D:
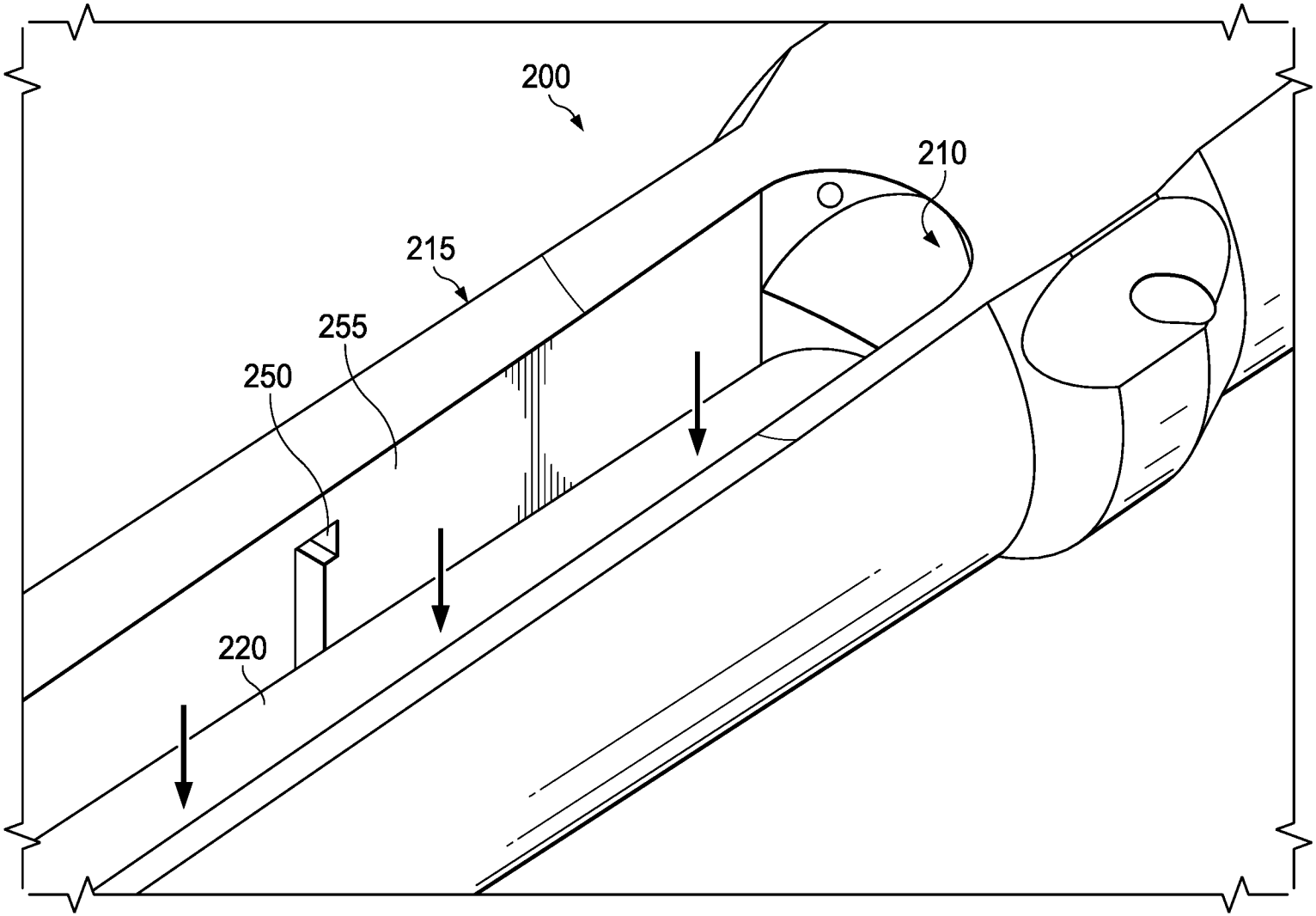
FIG. 2D is an enlarged view of the one aspect of the whipstock of FIG. 2A shown in a second position.

Turning now to FIG. 2B, there is shown a one aspect of the whipstock 200 near an uphole end thereof. In some embodiments, the support structure 220 may be coupled to the tubular 205 via a hinge pin 230, wherein the support structure 220 may be configured to rotate about the hinge pin 230 relative to the tapered face 215. As such, the support structure 220, once released by the locking mechanism 225, may translate angularly relative to the tapered face 215 as the support structure moves from the first closed position shown in FIG. 2A to the second open position shown in FIG. 2D. In some embodiments, the hinge pin 230 may be positioned in a linear slot 235. The linear slot 235 may allow the support structure to translate from a first linear position to a second linear position with respect to the tapered face 215. Traditionally, the hinge pin 230 will be in a downhole position in the linear slot 235 when the support structure 220 is in the first closed position and in an uphole position in the linear slot 235 when the support structure 220 is in the second open position. The embodiment illustrated in FIG. 2B shows the hinge pin 230 in an uphole position in the linear slot 235, as well as the support structure 220 rotated down in the second open position.

Turning to FIG. 2C, there is shown an enlarged view of certain aspects of the whipstock 200 near a downhole end thereof, and more particularly a location wherein the support structure 220 engages the tubular 205 when it is in the first closed position. In this embodiment, the locking mechanism 225 includes a pin 240. The pin 240, in some embodiments, may be configured to release the support structure 220 when severed by a downhole tool (e.g., a milling tool), riding up along the support structure 220 and over the tapered face 215. Once the support structure 220 has been released by the pin 240 and can move, one or more spring loaded release mechanisms 245, such as spring loaded pins in the illustrated embodiment, may be configured to engage the support structure 220 and urge the support structure 220 from the first linear position to the second linear position, thereby allowing the support structure 220 to rotate from the first closed position to the second open position.

In some embodiments, the pin 240 may be fabricated using a dissolvable material, including magnesium. After the milling process is complete, if the milling tool doesn't shear the pin 240, the pin 240 may dissolve. The time for dissolving may vary greatly. In one embodiment, the pin 240 might dissolve after about 60 minutes. In yet another embodiment, the pin 240 would dissolve before 7 days.

Turning to FIG. 2D, there is shown an enlarged view of certain aspects of the whipstock 200 shown in the second open position relative to the tapered face 215, for example wherein the longitudinal passageway 210 is exposed. In this embodiment, one or more shelf profiles 250 may be positioned on an inner surface 255 of the tubular 205 at one or more positions along the tapered face 215. The one or more shelf profiles 250 may be configured to engage one or more related support pins (not shown) coupled to the support structure 220 (e.g., on a bottom surface or side surface thereof). When the support structure 220 is in the first linear position, the one or more support pins on the support structure 220 are configured to engage the one or more shelf profiles 250 to the support structure 220 in the first closed position. As the support structure 220 is released from the locking mechanism 225, the support structure 220 moves to the second linear position, and the one or more related support pins disengage from the one or more shelf profiles 250, thereby allowing the support structure 220 to rotate relative to the tapered face 215 toward the second open position. In this illustrated embodiment, the one or more shelf profiles 250 are shown as L-shaped shelf profiles, but other shapes and profiles may be used for engaging the one or more related support pins.

Turning again to FIG. 2A, once the support structure 220 has been released and the longitudinal passageway 210 is exposed, a retrieval tool may thereafter access the longitudinal passageway 210 and engage an opening in an inner surface thereof for retrieval of the whipstock 200 uphole. In some embodiments, there may be another opening 270 in a longitudinal face of the support structure 220, the opening 270 configured to allow a retrieval tool to engage the whipstock 200 and withdraw the whipstock 200 uphole.

Figure 3A:
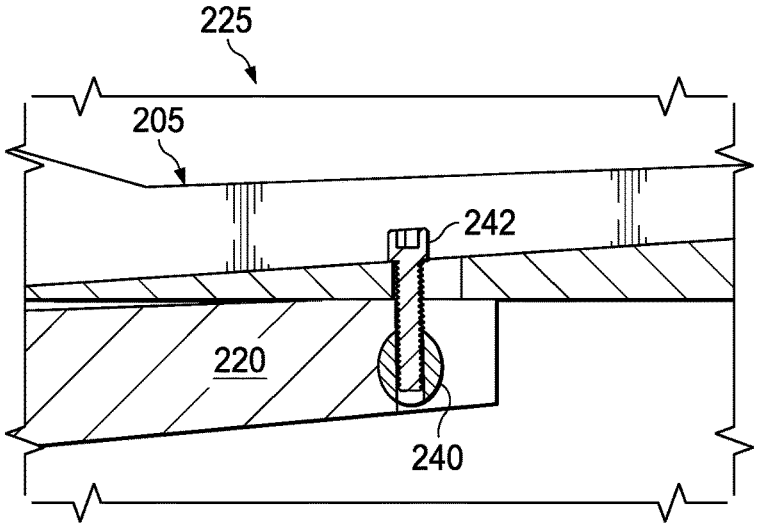
FIG. 3A illustrates one embodiment of a locking mechanism of the whipstock shown in FIG. 2A shown in a first state.
Figure 3B:
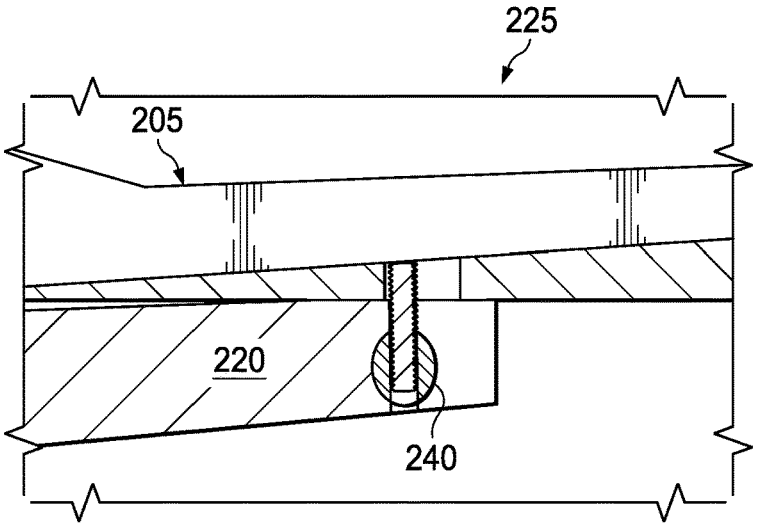
FIG. 3B illustrates the locking mechanism of the whipstock shown in FIG. 2A shown in a second state.
Figure 3C:
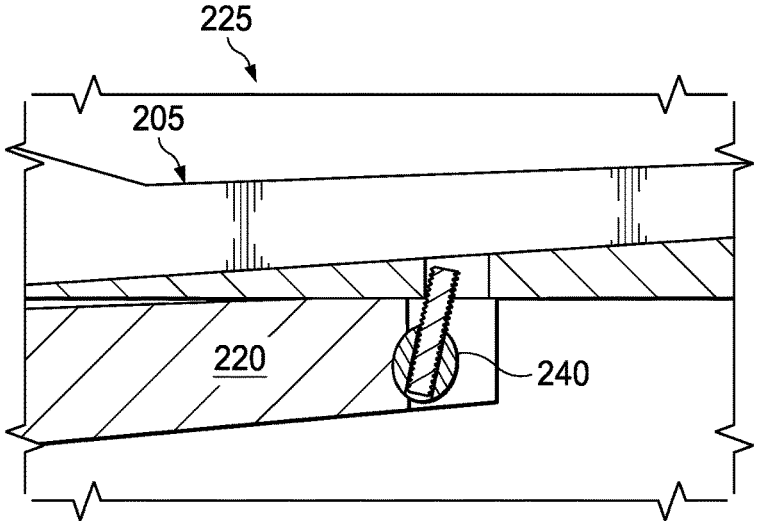
FIG. 3C illustrates the locking mechanism of the whipstock shown in FIG. 2A shown in a third state.

Turning now to FIGS. 3A-3C, there is shown one embodiment of the locking mechanism 225 in various engagements with the support structure 220. In FIG. 3A, the locking pin 240 is shown in a run in hole position, engaged with and holding the uphole end of the support structure 220 in the first closed position. As a downhole tool (e.g., a milling tool) is run into the wellbore and up along the support structure 220 over the whipstock 200, the downhole tool will contact and shear an exposed portion 242 of the pin 240, such as shown in FIG. 3B. As shown in FIG. 3C, the support structure 220 may then release from engagement with the tubular 205. Additionally, the spring loaded release mechanisms (not shown) may then urge the support structure 220 laterally (e.g., uphole in this embodiment), which as described above allows the support structure 220 to rotate from the first closed position to the second open position. As shown, the severed locking pin 240 may rotate relative to the support structure 220 when the support structure 220 moves from the first lateral position (e.g., as shown in FIG. 3B) to the second lateral position (e.g., as shown in FIG. 3C).

Figure 4:
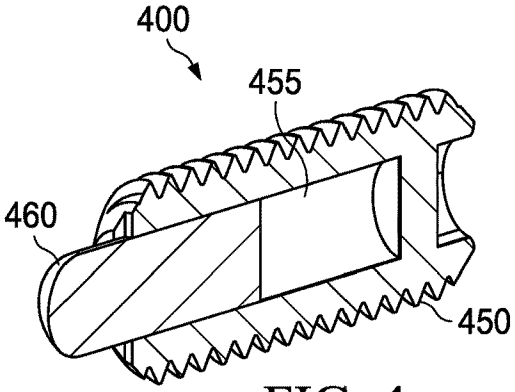
FIG. 4 illustrates one embodiment of a spring loaded release mechanism which may be used with the whipstock of FIG. 2A.

Turning now to FIG. 4, there is shown an embodiment of a spring loaded release mechanisms 400, which in some embodiments may be a long nosed spring plunger or a spring loaded pin configured to engage a structure, such as the support structure 220 as shown in FIG. 2C. In this embodiment, the spring loaded release mechanisms 400 may include an outer threaded portion 450 having a spring cavity 455 for a spring therein. A spring may be placed within the spring cavity 455 which may engage a nose member 460, the nose member 460 configured to engage and urge a body, such as urging the support member in some embodiments, laterally, and in some embodiments, both laterally and angularly.

Figure 5A:
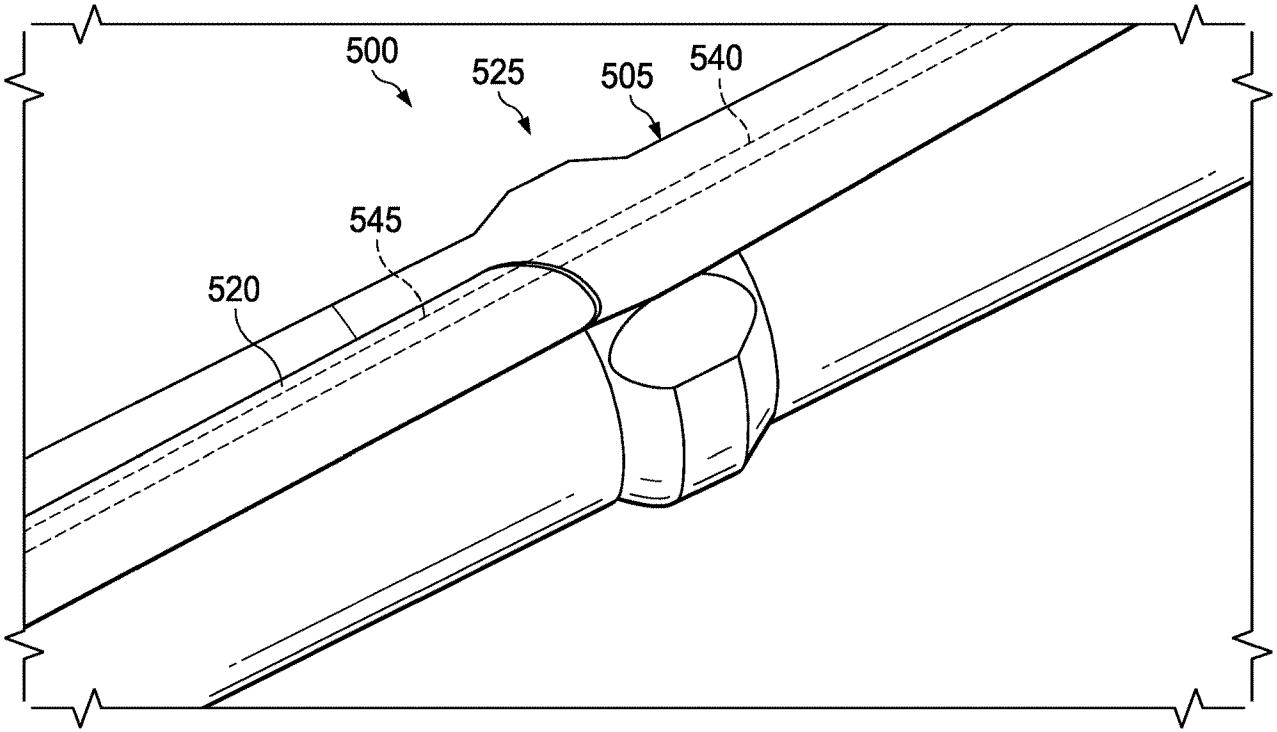
FIG. 5A illustrates a whipstock designed and manufactured according to one or more alternate embodiments of the disclosure.
Figure 5B:
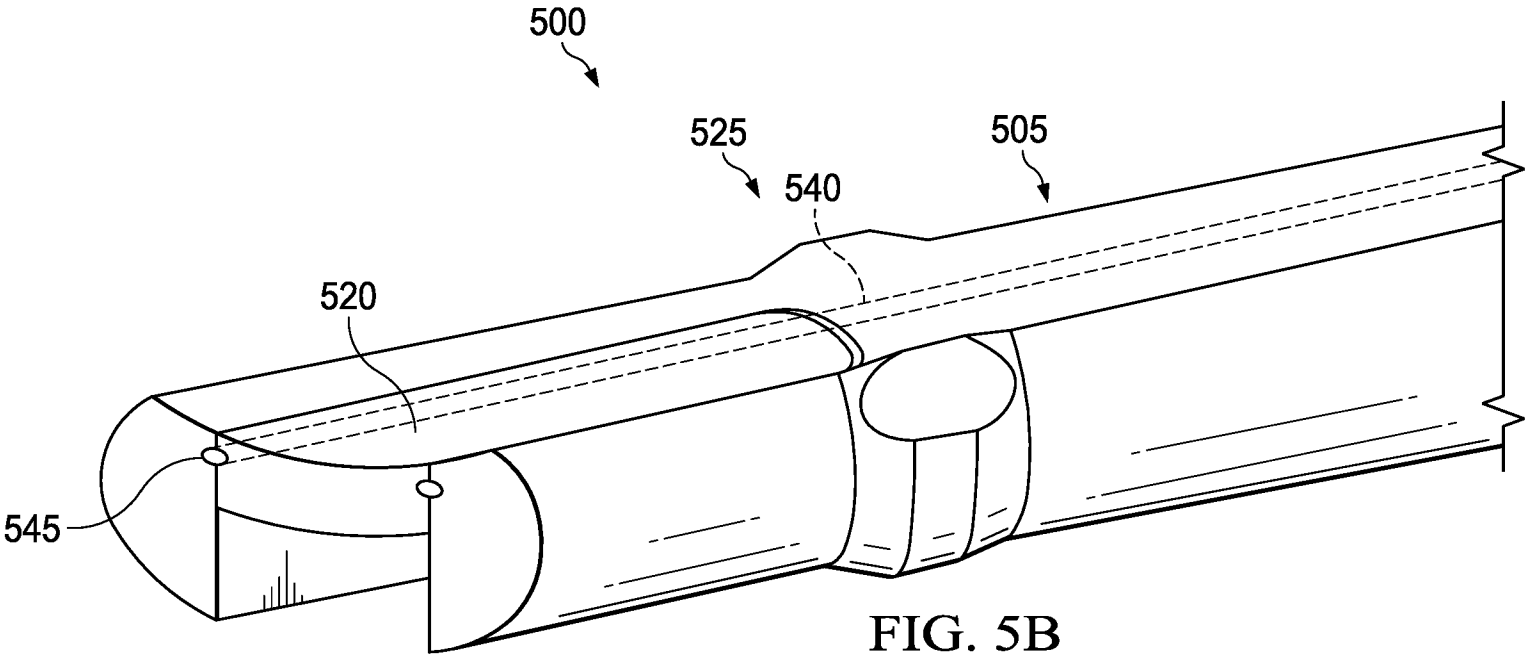
FIG. 5B illustrates one aspect of the whipstock shown in FIG. 5A.

Turning now to FIGS. 5A and 5B, there is shown another embodiment of a whipstock 500 according to principles of the disclosure. The whipstock 500 is similar in many respects to the whipstock 200 of FIGS. 2A-2D. Accordingly, like reference numbers have been used to reference similar, if not identical, features. The whipstock 500 differs, for the most part, from the whipstock 200, in that a locking mechanism 525 of whipstock 500 includes one or more dissolvable support rods 540 extending from the tubular 505 into the support structure 520. In some embodiments, the support structure 520 may include one or more slots 545 located along a length thereof. The one or more dissolvable support rods 540 may extend from the tubular 505 into the one or more slots 545 of the support structure 520. In some embodiments, the one or more slots 545 may extend along at least one fourth the length of the support structure 520. In other embodiments, the one or more slots 545 may extend anywhere from at least one half of the length of the support structure 520 to at least three fourths or more of the length of the support structure 520, and in some embodiments may extend the full length of the support structure 520. Once a downhole tool, such as a milling tool, has milled an opening in the lateral wellbore proximate the whipstock 500, the support surface 520 may then be exposed to fluids in the subterranean formation, which may include one or more dissolvable fluids. In some embodiments, the dissolvable support rods 540 may be configured to dissolve after coming into contact with at least one dissolvable fluid, thereby allowing the support structure 520 to move from the first closed position to the second open position. In some embodiments, the dissolvable support rods 540 may comprise magnesium and other alloys and may dissolve anywhere from about 60 minutes or up to 7 days after coming into contact with the dissolvable fluid. In this illustrated embodiment, additional mechanical release mechanisms may not be needed. The support structure 520 may move into the second open position after the dissolvable support rods 540 dissolve, or when the support structure 520 may be engaged by a retrieval tool.

Aspects disclosed herein include:

A. A whipstock, the whipstock including: 1) a tubular having a longitudinal passageway extending along a length thereof, the tubular having a tapered face extending along at least a portion of the length; 2) a support structure movably coupled to the tubular and extendable across the tapered face, wherein the support structure is operable to move from a first closed position closing the longitudinal passageway and a second open position exposing the longitudinal passageway; and 3) a locking mechanism in the tubular for releasably holding the support structure in the first position.

B. A method of using a whipstock in a wellbore, the method including: 1) placing a whipstock downhole into a wellbore, wherein the whipstock includes: a) a tubular having a longitudinal passageway extending along a length thereof, the tubular having a tapered face extending along at least a portion of the length; b) a support structure movably coupled to the tubular and extendable across the tapered face, wherein the support structure is operable to move from a first closed position closing the longitudinal passageway and a second open position exposing the longitudinal passageway; and c) a locking mechanism in the tubular for releasably holding the support structure in the first position; 2) running a milling tool downhole into the wellbore and riding the milling tool up along the support structure; 3) releasing the locking mechanism to release the support structure and expose the longitudinal passageway; 4) running a retrieval tool downhole into the wellbore; 5) engaging the whipstock with the retrieval tool; and 6) retrieving the whipstock from within the wellbore.

C. A well system, the well system including: 1) a main wellbore; 2) a lateral wellbore extending from the main wellbore; and 3) a whipstock placed within the lateral wellbore, wherein the whipstock includes: a) a tubular having a longitudinal passageway extending along a length thereof, the tubular having a tapered face extending along at least a portion of the length; b) a support structure movably coupled to the tubular and extendable across the tapered face, wherein the support structure is operable to move from a first closed position closing the longitudinal passageway and a second open position exposing the longitudinal passageway; and c) a locking mechanism in the tubular for releasably holding the support structure in the first position.

Aspects A, B, and C may have one or more of the following additional elements in combination: Element 1: wherein the support structure is coupled to the tubular via a hinge pin, the support structure configured to rotate about the hinge pin relative to the tapered face. Element 2: wherein the hinge pin is positioned in a linear slot, the linear slot configured to allow the support structure to translate from a first linear position to a second linear position with respect to the tapered face. Element 3: further including one or more shelf profiles on an inner surface of the tubular, the one or more shelf profiles configured to engage one or more related support pins coupled to the support structure, such that when the support structure is in the first linear position it is held in the first closed position and when the support structure is in the second linear position it is allowed to rotate toward the second open position. Element 4: wherein the one or more shelf profiles are one or more L-shaped shelf profiles. Element 5: further including one or more spring loaded release mechanisms configured to engage the support structure and urge it from the first linear position to the second linear position. Element 6: wherein the locking mechanism includes a pin, the pin configured to release the support structure when severed by a downhole tool riding up along the support structure. Element 7: wherein the locking mechanism includes one or more dissolvable support rods extending from the tubular into the support structure. Element 8: wherein the support structure includes one or more slots located along a length thereof, the one or more dissolvable support rods extending from the tubular into the one or more slots of the support structure. Element 9: wherein the one or more slots are located along at least one fourth the length of the support structure. Element 10: wherein the dissolvable support rods are configured to dissolve anywhere from about 60 minutes to about 7 days after coming into contact with a dissolvable fluid, thereby allowing the support structure to move from the first closed position to the second open position. Element 11: further including an opening in a longitudinal face of the support structure, the opening configured to allow a retrieval tool to engage the whipstock and withdraw the whipstock uphole. Element 12: wherein the locking mechanism includes a pin and releasing the locking mechanism includes shearing the pin with the milling tool, thereby releasing the support structure from the first closed position to the second open position and exposing the longitudinal passageway. Element 13: wherein locking mechanism includes one or more dissolvable support rods extending from the tubular into the support structure and wherein releasing the locking mechanism includes the exposing the dissolvable support rods with a dissolvable fluid, wherein the dissolvable support rods are configured to dissolve anywhere from about 60 minutes to about 7 days after coming into contact with the dissolvable fluid, thereby allowing the support structure to move from the first closed position to the second open position. Element 14: wherein the whipstock further includes further an opening in a longitudinal face of the support structure, wherein engaging the whipstock with the retrieval tool includes engaging the opening in the longitudinal face of the support structure. Element 15: wherein the support structure is coupled to the tubular via a hinge pin, the support structure configured to rotate about the hinge pin relative to the tapered face and wherein the hinge pin is positioned in a linear slot, the linear slot configured to allow the support structure to translate from a first linear position to a second linear position with respect to the tapered face. Element 16: wherein the whipstock further includes one or more shelf profiles on an inner surface of the tubular, the one or more shelf profiles configured to engage one or more related support pins coupled to the support structure, such that when the support structure is in the first linear position it is held in the first closed position and when the support structure is in the second linear position it is allowed to rotate toward the second open position. Element 17: wherein the locking mechanism includes one or more dissolvable support rods extending from the tubular into the support structure, wherein the support structure includes one or more slots located along a length thereof, the one or more dissolvable support rods extending from the tubular into the one or more slots of the support structure.

Those skilled in the art to which this application relates will appreciate that other and further additions, deletions, substitutions and modifications may be made to the described embodiments.

What is claimed is:

1. A whipstock, comprising:

a tubular having a longitudinal passageway extending along a length thereof, the tubular having a tapered face extending along at least a portion of the length;

a support structure movably coupled to the tubular and extendable across the tapered face, wherein the support structure is operable to rotate radially inward from a first closed position closing the longitudinal passageway to a second open position exposing the longitudinal passageway; and a locking mechanism in the tubular for releasably holding the support structure in the first position, the locking mechanism including a pin extending above an exposed face of the support structure as well as above a second exposed face of the tapered face, the pin configured to shear as a wellbore tool rides over the pin and along at least one of the exposed face or the second exposed face.

2. The whipstock according to claim 1, wherein the support structure is coupled to the tubular via a hinge pin, the support structure configured to rotate about the hinge pin relative to the tapered face.

3. The whipstock according to claim 2, wherein the hinge pin is positioned in a linear slot, the linear slot configured to allow the support structure to translate from a first linear position to a second linear position with respect to the tapered face.

4. The whipstock according to claim 3, further including one or more shelf profiles on an inner surface of the tubular, the one or more shelf profiles configured to engage one or more related support pins coupled to the support structure, such that when the support structure is in the first linear position it is held in the first closed position and when the support structure is in the second linear position it is allowed to rotate toward the second open position.

5. The whipstock according to claim 4, wherein the one or more shelf profiles are one or more L-shaped shelf profiles.

6. The whipstock according to claim 3, further including one or more spring loaded release mechanisms configured to engage the support structure and urge it from the first linear position to the second linear position.

7. The whipstock according to claim 1, further including an opening in a longitudinal face of the support structure, the opening configured to allow a retrieval tool to engage the whipstock and withdraw the whipstock uphole.

8. A method of using a whipstock in a wellbore, the method comprising:

placing a whipstock downhole into a wellbore, wherein the whipstock includes:

a tubular having a longitudinal passageway extending along a length thereof, the tubular having a tapered face extending along at least a portion of the length;

a support structure movably coupled to the tubular and extendable across the tapered face, wherein the support structure is operable to rotate radially inward from a first closed position closing the longitudinal passageway to a second open position exposing the longitudinal passageway; and a locking mechanism in the tubular for releasably holding the support structure in the first position;

running a milling tool downhole into the wellbore and riding the milling tool up along the support structure;

releasing the locking mechanism to release the support structure and expose the longitudinal passageway, wherein the locking mechanism includes a pin and releasing the locking mechanism includes shearing the pin with the milling tool, thereby releasing the support structure from the first closed position to the second open position and exposing the longitudinal passageway;

running a retrieval tool downhole into the wellbore;

engaging the whipstock with the retrieval tool; and retrieving the whipstock from within the wellbore.

9. The method according to claim 8, wherein the whipstock further includes an opening in a longitudinal face of the support structure, wherein engaging the whipstock with the retrieval tool includes engaging the opening in the longitudinal face of the support structure.

10. A well system, comprising:

a main wellbore;

a lateral wellbore extending from the main wellbore; and a whipstock placed within the lateral wellbore, wherein the whipstock includes:

a tubular having a longitudinal passageway extending along a length thereof, the tubular having a tapered face extending along at least a portion of the length;

a support structure movably coupled to the tubular and extendable across the tapered face, wherein the support structure is operable to rotate radially inward from a first closed position closing the longitudinal passageway to a second open position exposing the longitudinal passageway; and a locking mechanism in the tubular for releasably holding the support structure in the first position, the locking mechanism including a pin extending above an exposed face of the support structure as well as above a second exposed face of the tapered face, the pin configured to shear as a wellbore tool rides over the pin and along the exposed face or the second exposed face.

11. The well system according to claim 10, wherein the support structure is coupled to the tubular via a hinge pin, the support structure configured to rotate about the hinge pin relative to the tapered face and wherein the hinge pin is positioned in a linear slot, the linear slot configured to allow the support structure to translate from a first linear position to a second linear position with respect to the tapered face.

12. The well system according to claim 10, wherein the whipstock further includes one or more shelf profiles on an inner surface of the tubular, the one or more shelf profiles configured to engage one or more related support pins coupled to the support structure, such that when the support structure is in the first linear position it is held in the first closed position and when the support structure is in the second linear position it is allowed to rotate toward the second open position.

* * * * *